US006116928A

United States Patent [19]

Tsuji et al.

[11] Patent Number: 6,116,928

[45] Date of Patent: Sep. 12, 2000

[54] STRUCTURE FOR CONNECTING CONNECTORS

[75] Inventors: Masanori Tsuji; Osamu Sugiyama, both of Shizuoka, Japan

[73] Assignee: Yazaki Corporation, Tokyo, Japan

[21] Appl. No.: 09/261,215

[22] Filed: Mar. 3, 1999

[30] Foreign Application Priority Data

Mar. 4, 1998 [JP] Japan ..... 10-052433

[51] Int. Cl.[7] ..... H01R 13/62

[52] U.S. Cl. ..... 439/157; 439/347; 439/489

[58] Field of Search ..... 439/157, 347, 439/310, 488, 489, 152, 153, 372

[56] References Cited

U.S. PATENT DOCUMENTS

| | | | |
|---|---|---|---|
| 5,320,556 | 6/1994 | Otaka et al. | 439/489 |
| 5,376,017 | 12/1994 | Taniuchi et al. | 439/489 |
| 5,480,324 | 1/1996 | Maegawa et al. | 439/489 |
| 5,915,982 | 6/1999 | Kashiyama et al. | 439/157 |

FOREIGN PATENT DOCUMENTS

| | | |
|---|---|---|
| 0 363 804 | 4/1990 | European Pat. Off. . |
| 0 825 684 | 2/1998 | European Pat. Off. . |
| 0 883 212 | 12/1998 | European Pat. Off. . |
| 8-315913 | 11/1996 | Japan . |
| 2 300 767 | 11/1996 | United Kingdom . |

*Primary Examiner*—Gary F. Paumen
*Assistant Examiner*—Tho D. Ta
*Attorney, Agent, or Firm*—Sughrue, Mion, Zinn, Macpeak & Seas, PLLC

[57] ABSTRACT

A female connector 30 is provided with a reciprocative and slidable slide member 13; an operation lever 20 rotatably coupled to the connector for sliding the slide member 13 within the connector; and a guide groove 14 and a guide pin 44 arranged to be engaged to the slide member 13 and a male connector 40. The operation lever 20 is rotated to introduce the male connector 40 into the female connector 30 so that the two connectors are connected to each other. A projection 27 arranged to be brought into contact with the outer surface of the male connector 40 when the guide groove 14 and the guide pin 44 have incompletely been connected to each other is integrally provided with a side wall 22 of the operation lever 20 so as to prevent rotation of the operation lever 20. Thus, the connector structure will resist breakage and deformation even if excessive force is exerted on the lever when attempting to secure a connection while the male and female connectors are not completely connected.

7 Claims, 8 Drawing Sheets

STRUCTURE FOR CONNECTING CONNECTORS

BACKGROUND OF THE INVENTION

1. Field of the Invention

The present invention relates to a structure for connecting connectors which uses leverage obtainable when an operation lever has been rotated to connect multipole male and female connectors to each other or separate the same from each other using a small operating force.

2. Related Art

Hitherto, a structure for connecting connectors of the foregoing type has been disclosed in Japanese Patent Laid-Open No. 8-315913. FIGS. 7 to 9 show a conventional structure for connecting connectors to each other. Two guide pins 62 are provided for the outer surfaces of opposite walls 61 of a connector housing 60. Moreover, a guide projection 63 is disposed adjacent to either of the guide pins 62. A pair of slide members 65 slidable with respect to the connector housing 60 are joined to the outer surfaces of the walls 61 of the connector housing 60.

Each of the slide members 65 has guide grooves 66 inclined diagonally upwards. The guide pins 62 of the connector housing 60 are slidably inserted into the guide grooves 66. A guide opening 67, into which the guide projection 63 of the connector housing 60 is introduced, is communicated with either of the guide grooves 66.

FIG. 8 shows a normal state in which the guide projection 63 has been introduced into the guide opening 67. In the foregoing state, the guide pins 62 face inlet portions of the guide grooves 66. An operation lever (not shown) to which the slide members 65 are connected is rotated to slide the slide members 65 by leverage. Thus, the connector housing 60 can be introduced into the slide members 65 by applying only a small force.

When the slide members 65 are slid in a state in which the guide projection 63 has not been introduced into the guide opening 67, an inlet portion of the guide grooves 66 is held between the guide projection 63 and the guide pin 62, as shown in FIG. 9. Therefore, sliding of the slide members 65 is inhibited. As a result, a state deviated from the normal position can be detected.

However, the conventional structure encounters exertion of an excessively large force on the guide projection 63 when leverage is used to rotate the operation lever. Therefore, there arises a problem in that the inlet portion of the guide projection 63 or the guide grooves 66 is broken or deformed.

SUMMARY OF THE INVENTION

Therefore, an object of the present invention is to provide a structure for connecting connectors which is not broken or deformed even if a large force is exerted on the structure when in a state deviated from the normal position.

To achieve the foregoing object, according to one embodiment of the present invention, there is provided a structure for connecting connectors, comprising: a reciprocative and slidable slide member provided for either of a male connector or a female connector; a rotative operation lever for sliding the slide member; a guide groove and a guide pin arranged to be engaged to the slide member and the other connector so that a rotational operation of the operation lever causes the connector to be introduced into the other connector so as to connect the two connectors to each other, and so that a reverse rotational operation of the operation lever causes the two connectors to be separated from each other; and a projection integral with the operation lever and arranged to be brought into contact with the outer surface of the other connector when the guide groove and the guide pin have been incompletely connected to each other so as to prevent rotation of the operation lever.

According to the foregoing embodiment, the projection provided for the operation lever is brought into contact with the connector in a state in which the guide groove and the guide pin are incompletely connected to each other. Therefore, rotation of the operation lever is inhibited so that incomplete connection between the connectors is prevented. Since the projection is integrally provided for the operation lever, the strength of the connector can be increased. Since the projection is brought into contact with the outer surface of the other connector, the outer surface of the other connector having great strength receives the projection. Therefore, great force for preventing the rotation of the operation lever can be used to prevent rotation of the operation lever. Thus, the rotation of the operation lever can reliably be inhibited. Moreover, breakage and deformation can satisfactorily be prevented when the rotation is inhibited.

In another embodiment of the present invention, the projection is provided in a side wall portion of the operation lever so that incomplete connection between the guide pin and the guide groove can be detected when introduction of the other connector is started. As a result, ensuing countermeasures can quickly be taken.

In yet another embodiment the present invention, the projection projects to cover a portion of the outer surface of the other connector in a state in which the other connector has completely been introduced into the connector. Accordingly, movement of the other connector in the direction of separation is inhibited by the projection. Therefore, the connectors can stably be connected to each other.

DETAILED DESCRIPTION OF THE PREFERRED EMBODIMENT

Figure 1:
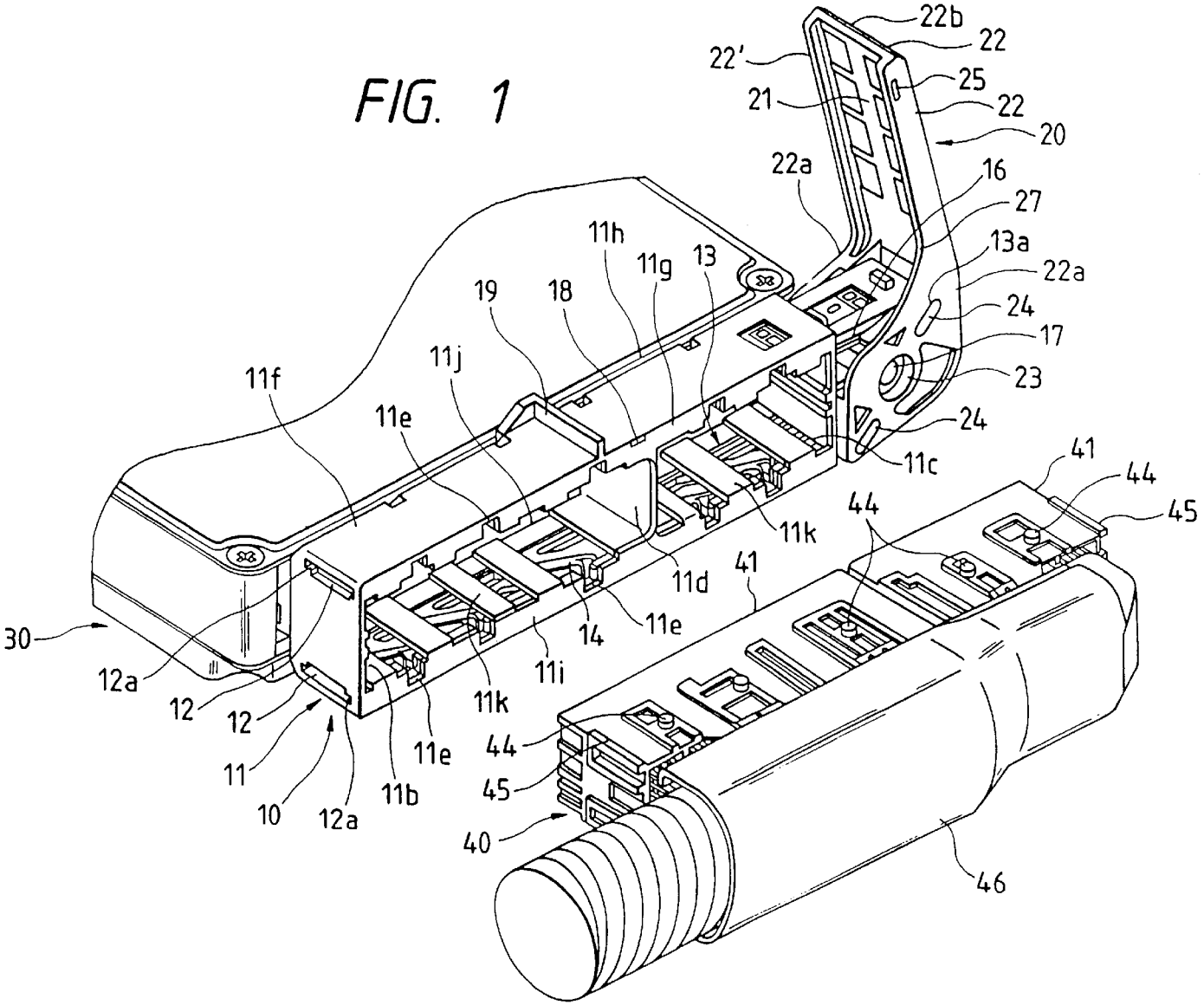
FIG. 1 is a perspective view showing a state before the connection between the male and female connectors of a structure for connecting connectors according to an embodiment of the present invention is established.
Figure 2:
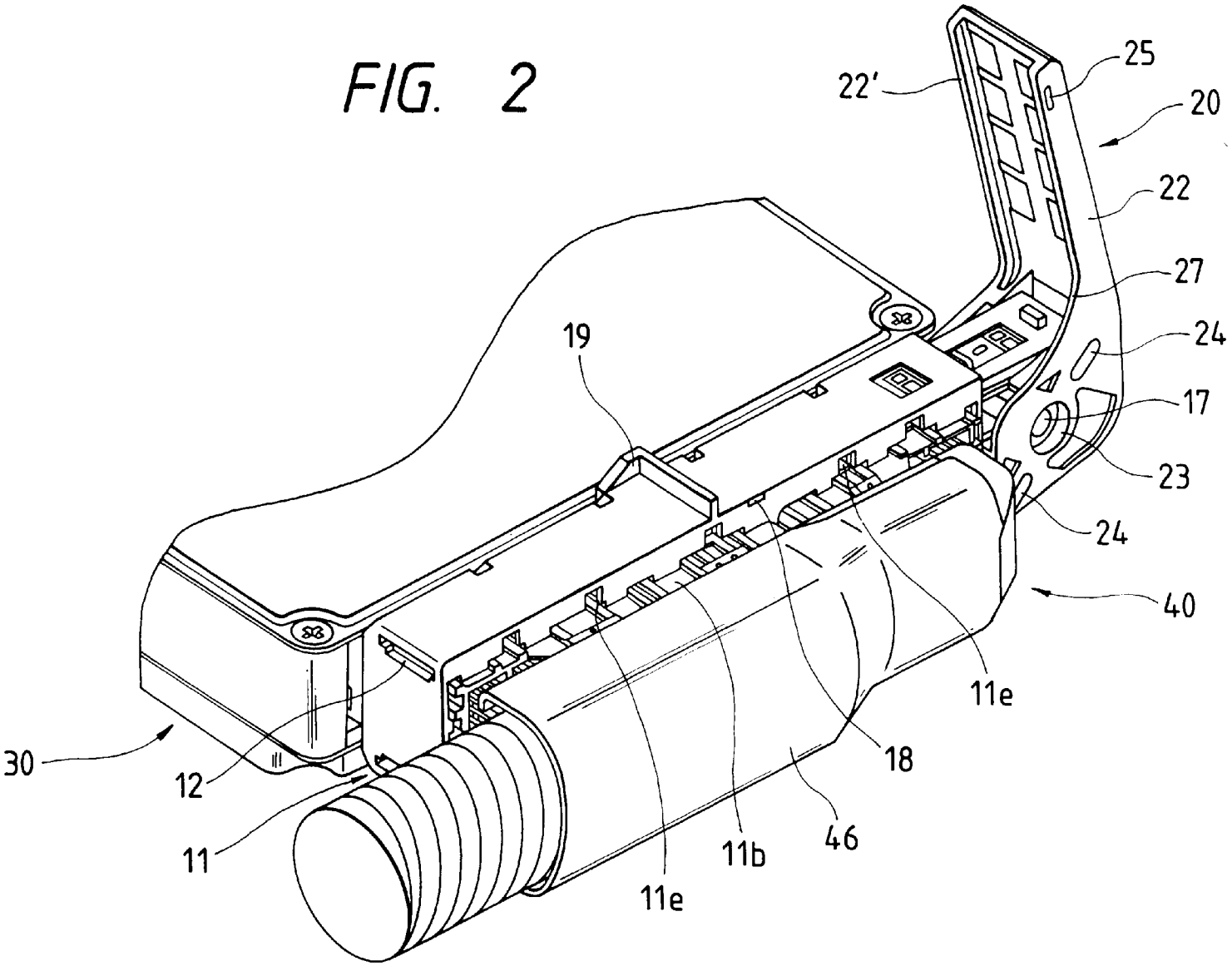
FIG. 2 is a perspective view showing a state in which the male connector is introduced in a state in which the guide pins and guide grooves have completely been connected to one another.

An embodiment of the present invention will now be described with reference to the drawings. FIG. 1 is an exploded perspective view showing a structure for connecting connectors according to the embodiment of the present invention. FIG. 2 is a perspective view showing a state in which male and female connectors have been connected to each other.

The structure for connecting connectors according to this embodiment incorporates a female connector 30 (the connector) and a male connector 40 (the other connector), which are made of synthetic resin, and a hood assembly 10. The male connector 40 is introduced into the female connector 30 through the hood assembly 10.

The hood assembly 10 incorporates a hood 11 formed into a hollow rectangular or square shape having a rear surface to which the female connector 30 is connected. The male connector 40 is inserted into an opening 11*b* formed in the front surface of the hood assembly 10. Thus, the hood 11 also serves as the housing for the female connector 30. Moreover, the hood assembly 10 incorporates a pair of slide members 13 which are inserted into a pair of upper and lower insertion openings 11*c* formed in one side-wall of the hood 11 so as to be slid in a reciprocative manner along a pair of upper and lower slide grooves 12 formed in the upper and lower portions of the wall of the hood 11. In addition, the hood 11 incorporates an operation lever 20 for performing reciprocative sliding of each of the slide members 13 to connect the female and male connectors 30 and 40 to each other or separate the same from each other, the operation lever 20 being made of synthetic resin.

The inside portion of an opening 11*b* of the hood 11 is, by a partition wall 11*d,* sectioned into two male-connector accommodating chambers. The pair of the upper and lower slide grooves 12 of the hood 11 are provided with a pair of step portions 12*a* for holding thin-wall portions of the two side ends of the pair of the slide members 13. The pair of the slide members 13 are slid in a reciprocative manner in the opposite directions in the pair of the slide grooves 12.

The pair of the slide grooves 12 are formed between a front surface 11*g* and a rear surface 11*h* of the upper wall of the hood 11 and between a front surface 11*i* and a rear surface 11*j* of the lower wall of the same. A plurality of bridge ribs 11*k* formed perpendicular to the slide direction of the slide member 13 establish the connection between the front surface 11*g* and the rear surface 11*h* of the upper wall and between the front surface 11*i* and the rear surface 11*j* of the lower wall. Therefore, deflection of each of the front surfaces 11*g* and 11*i* and the rear surfaces 11*h* and 11*j* is prevented when the female and male connectors 30 and 40 are connected to each other.

A plurality of cut guides 11*e* are formed in each of the upper and lower front surfaces 11*g* and 11*i* of the hood 11. The cut guides 11*e* are disposed opposite to an introduction grooves 14*a* of the guide grooves 14 of the pair of the slide members 13.

Figure 3A:
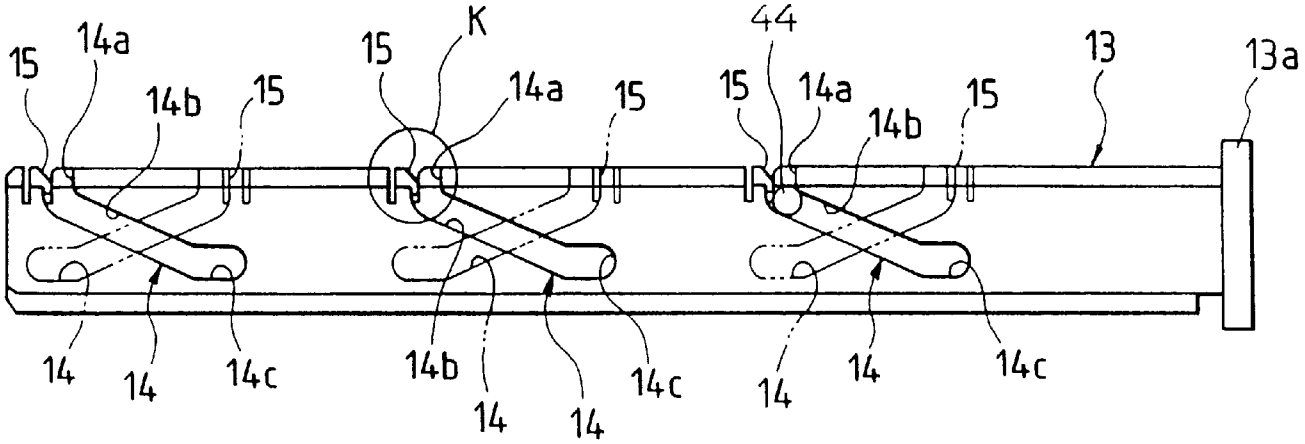
FIG. 3(A) is a diagram showing a slide member which is viewed from the guide groove.

The plural guide grooves 14 inclined to make a predetermined angle from a direction into which each of the slide members 13 is inserted are formed in the opposite surfaces of the pair of the slide members 13. As indicated by a solid line and an alternate long and short dash line shown in FIG. 3(A), the directions of inclination of the guide grooves 14 of the upper slide member 13 and the lower slide member 13 are opposite to each other. As shown in FIG. 3(A), each of the guide grooves 14 has an introduction groove 14*a* opened at either end surface of the guide groove 14 and formed substantially perpendicular to the end surface; an inclined groove 14*b* continued from the introduction grooves 14*a;* and an end groove 14*c* continued from the inclined groove 14*b* and formed in parallel with the lengthwise direction of the slide members 13.

Figure 3B:
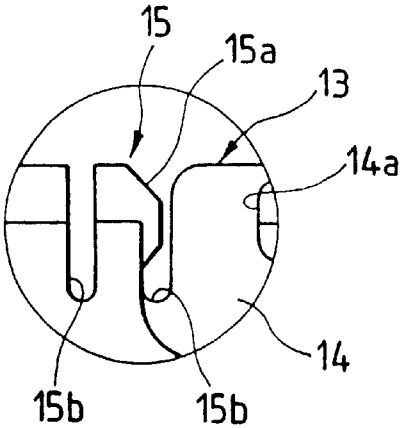
FIG. 3(B) is an enlarged view showing a portion K shown in FIG. 3(A)

As shown in FIG. 3(B), a temporary engagement means 15 for temporarily engaging each of guide pins 44 is formed at either end of the introduction groove 14*a* which is an inlet portion of each of the guide pins 44 of the guide grooves 14, the guide pins 44 being described later. The temporary engagement means 15 is constituted by a flexible projection 15*a* projecting integrally with the temporary engagement means 15 to be in parallel with the introduction groove 14*a* of the guide grooves 14; and a pair of cut portions 15*b* formed on the two sides of the flexible projection 15*a*.

The operation lever 20 causes the pair of the slide members 13 to slide in a reciprocative manner in opposite directions. The operation lever 20 is formed into a U-shape facing side by a flat portion 21 and two side walls 22 and 22' extending downwards from the two sides of the flat portion 21. Each of the base portions 22*a* of the two side walls 22 and 22', each of which is formed into the U-shape facing side, is formed into a substantially rhombic shape. A rotation-center hole 23 is formed at the center of the base portion 22*a*. A support shaft 17 on the two sides of the lever joining portion 16 projecting between a pair of upper and lower insertion openings 11*c* of the side wall of the hood 11 is inserted into the rotation-center hole 23. The operation lever 20 is able to rotate around the support shaft 17 into a vertical position.

A pair of elongated holes 24 are formed in the opposite corners of the base portions 22*a* of the two side walls 22 and 22' of the operation lever 20 to interpose the rotation-center hole 23 therebetween. Cylindrical joining projections 13*a* of the pair of the upper and lower slide members 13 are inserted into the pair of the elongated holes 24. When the operation lever 20 has been rotated to a vertical position, the pair of the upper and lower slide members 13 are slid in a reciprocative manner in opposite directions.

The inner surface of the flat portion 21 of the operation lever 20 is wider than an upper surface 11*f* of the upper portion of the front wall of the hood 11. Moreover, the two side walls 22 and 22' of the operation lever 20 project downwardly to interpose the front surface 11*g* and the rear surface 11*h* of the front upper wall of the hood 11 therebetween. Leading ends 22*b* of the, two side walls 22 and 22' reach a substantially central portion of the upper surface 11*f* of the upper portion of the front wall of the hood 11. A rectangular engaging hole 25 is formed in the side wall 22 (in the front surface 11*g* of the hood 11) of the two side walls 22 and 22' of the operation lever 20, the engaging hole 25 being formed adjacent to a leading end 22*b* of the side wall 22. An engaging projection 18 arranged to be engaged to and separated from the engaging hole 25 integrally projects over the front surface 11*g* of the upper portion of the front wall of the hood 11 which is opposite to the engaging hole 25.

A rib 19 for protecting the operation lever 20 and preventing an erroneous release integrally projects over the upper surface of the hood 11.

A projection (or contact portion) 27 is formed integrally with the operation lever 20. The projection 27 is formed on the side wall 22 of the two side walls 22 and 22' of the operation lever 20 into which the male connector 40 is introduced. The projection 27 is warped and allowed to project over the base portion 22*a* of the two side wall 22 toward the leading end 22*b*. The projection 27 is integrally formed on the side wall 22 as described above. Therefore, the projection 27 is made to contact the male connector 40 when the male connector 40 is introduced in a state in which the guide grooves 14 of the hood 11 and the guide pins 44 of the male connector 40 are incompletely engaged to one another, as shown in FIG. 4 (B). Thus, the contact made as described above prevents downward rotation of the operation lever 20.

Figure 5:
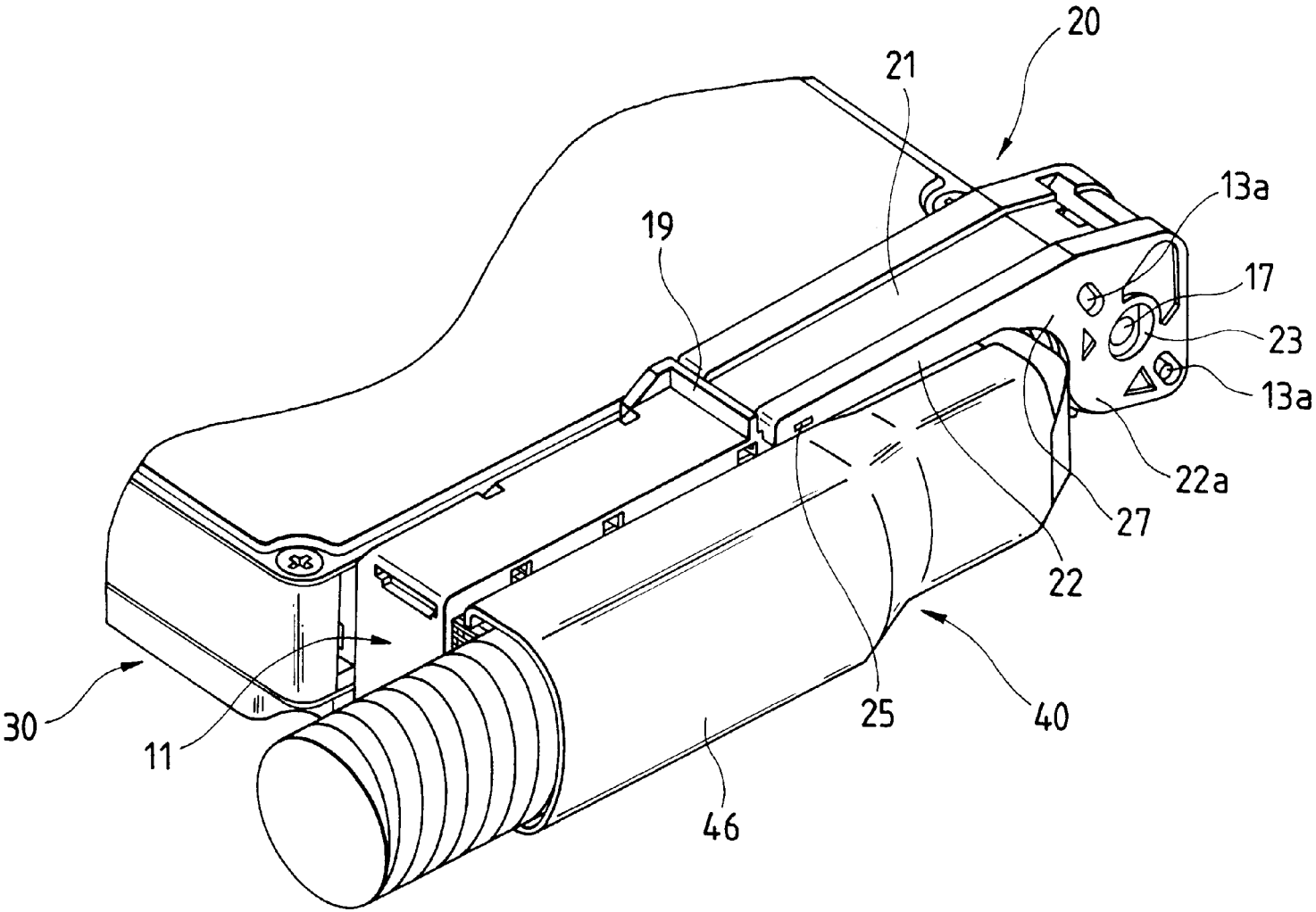
FIG. 5 is a perspective view showing a state in which the male connector has been introduced into the female connector.

A distance of projection of the projection 27 is, as shown in FIG. 5, determined to cover a portion of the outer surface of the male connector 40 when the male connector 40 has completely been introduced into the female connector 30 and thus complete connection between the two connectors 30 and 40 has been established. Since the projection 27 of the operation lever 20 covers the outer surface of the male connector 40 as described above, undesirable separation of the connected male connector 40 can be prevented.

A pair of box-shape connector housings 41 of the male connector 40 are inserted into the opening 11*b* formed in the front portion of the hood 11 from a direction perpendicular to a direction in which each of the slide members 13 is moved. A plurality of guide pins 44 arranged to be engaged to the cut guides 11*e* and arranged to movably be inserted into the guide grooves 14 of the slide members 13 when the two connectors 30 and 40 are connected to each other are integrally formed to project over the upper and lower surfaces of the connector housings 41. Guide ribs 45 extending in the direction in which the male connector 40 is introduced project over the upper and lower portions of the two ends of the male connector. The guide ribs 45 are engaged to groove-shaped rib guides 11*m* provided with the hood 11 so as to be formed into introducing guides for the guide ribs 45. The projection 27 of the operation lever 20 is able to make contact with the guide ribs 45.

An electric wire is connected to a terminal inserted into the male connector 40, while an electric wire exposed to the outside is covered by a cover 46.

According to this embodiment, the male connector 40 is inserted into the hood 11 from a position opposite to the female connector 30 as shown in FIG. 2 in a state in which the hood assembly 10 has been mounted on the female connector 30 as shown in FIG. 1. Then, the guide pins 44 of the male connector 40 are introduced into the introduction grooves 14*a* of the guide grooves 14 of the slide members 13 through the cut guides 11*e* of the hood 11.

When the operation lever 20 is rotated downwards in the foregoing state, each of the slide members 13 slides, in each of the slide grooves 12 of the hood 11, in the reciprocating direction. As a result, the guide pins 44 are moved from the introduction grooves 14*a* of the guide grooves 14 to the end groove 14*c* through the inclined grooves 14*b*. Thus, the male connector 40 is introduced into the hood 11 so that the two connectors 30 and 40 are connected to each other.

The state of connection between the multipole connectors, that is, between the female connector 30 and the male connector 40, is reliably locked when the engaging projection 18 of the front surface 11*g* of the hood 11 is engaged to the engaging hole 25 of the side wall 22 of the operation lever 20 as shown in FIG. 5 at a moment of time when the downward rotation of the operation lever 20 has been completed. Simultaneously, the projection 27 provided for the operation lever 20 covers a portion of the outer surface of the male connector 40, as shown in FIG. 5. Thus, undesirable movement of the male connector 40 in the direction of separation can be prevented. As a result, a stable state of the connection between the two connectors 30 and 40 can be maintained.

When the operation lever 20 has been rotated upwards, each of the slide members 13 is slid in each of the slide grooves 12 of the hood 11 in the reciprocating direction. As a result, each of the guide pins 44 is moved from the end groove 14*c* of each of the guide grooves 14 to the introduction groove 14*a* through the inclined groove 14*b*. Thus, the male connector 40 is separated from the inside portion of the hood 11 so that the female and male connectors 30 and 40 are separated from each other.

Figure 4A:
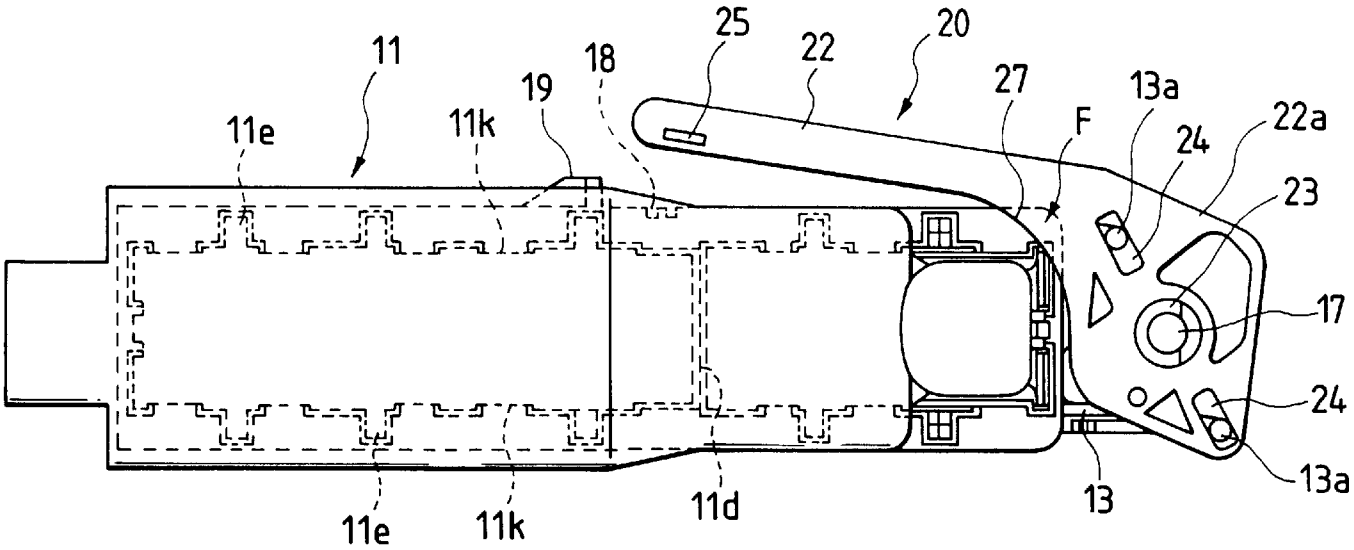
FIG. 4(A) is a front view showing a state in which an operation lever has been rotated in a state in which the guide pins and the guide grooves have incompletely been connected to one another.
Figure 4B:
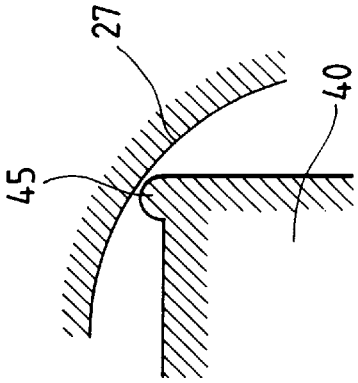
FIG. 4(B) shows an enlarged front view showing portion F shown in FIG. 4(A).
Figure 6:
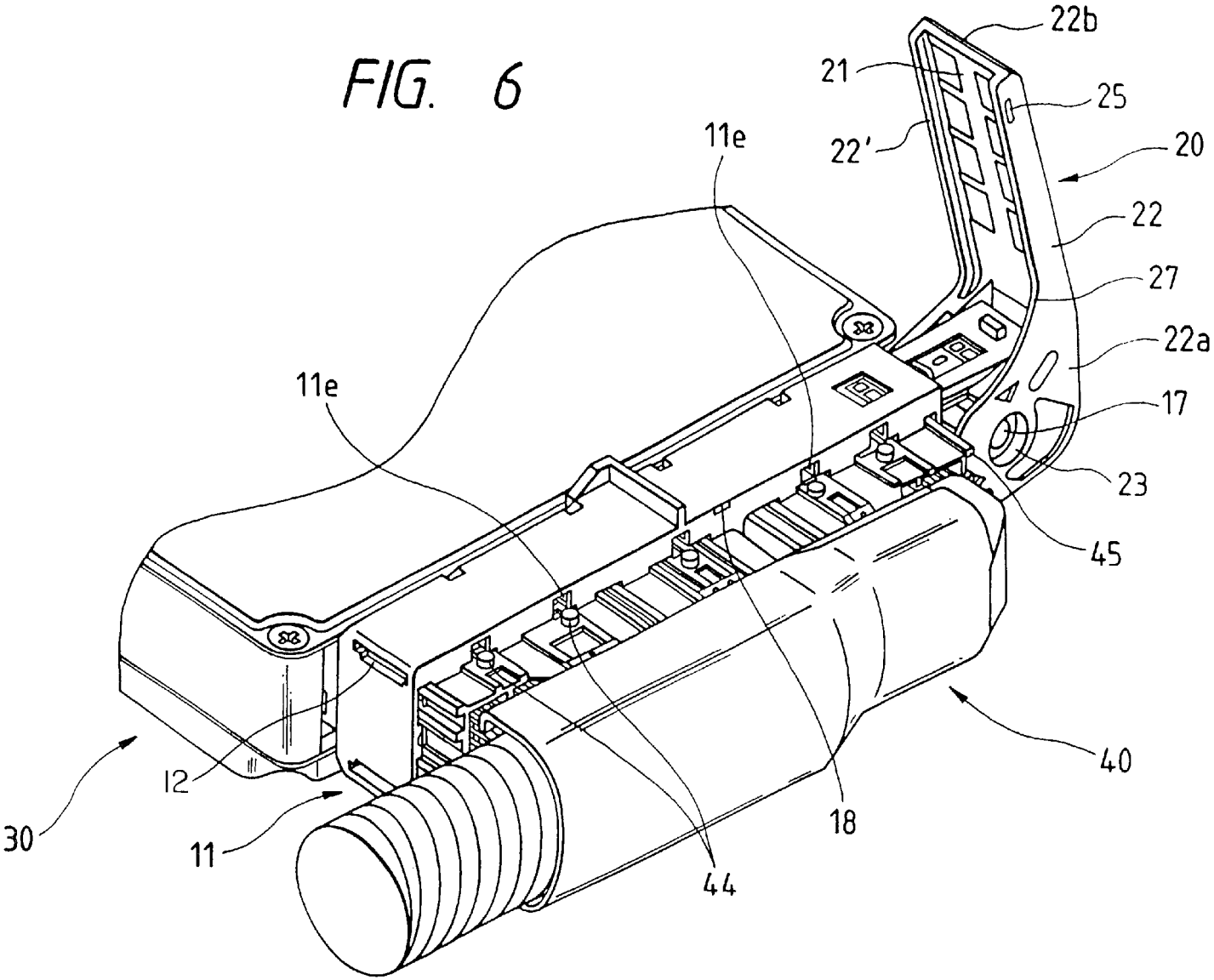
FIG. 6 is a perspective view showing a state in which the male connector is introduced in a state in which the guide pins and the guide grooves have incompletely been connected to one another.
Figure 7:
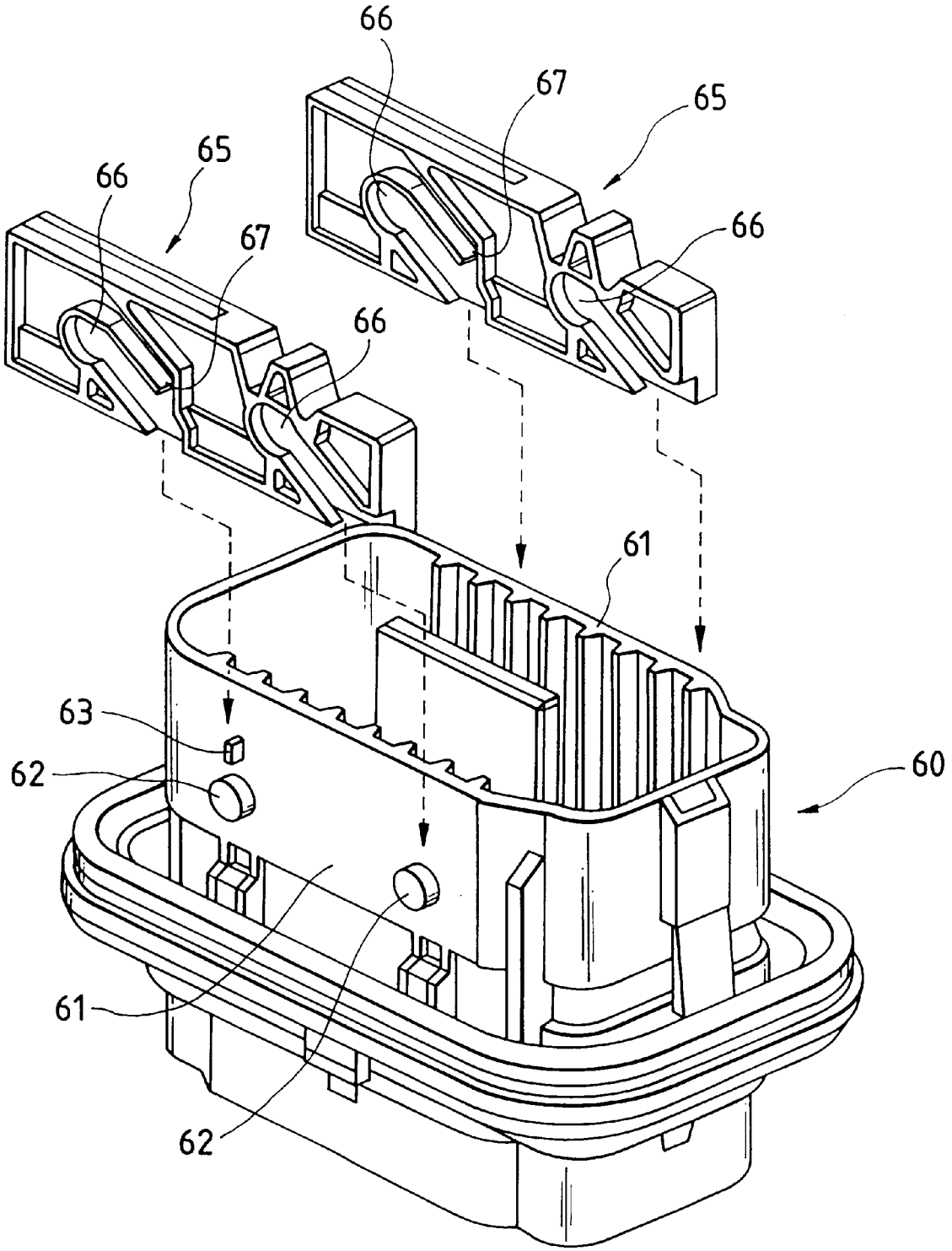
PRIOR ART FIG. 7
FIG. 7 is an exploded perspective view showing a conventional structure.
Figure 8:
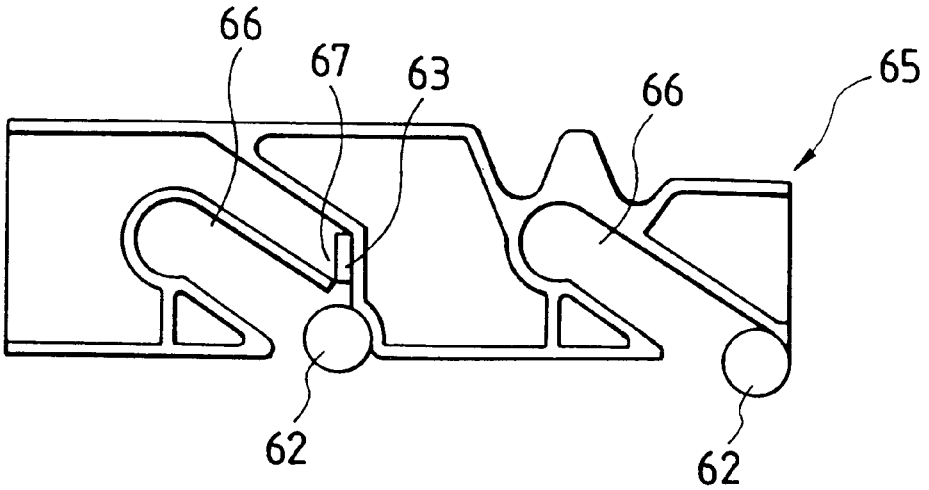
PRIOR ART FIG. 8
FIG. 8 is a front view showing the operation of the conventional structure which is performed in a normal state.
Figure 9:
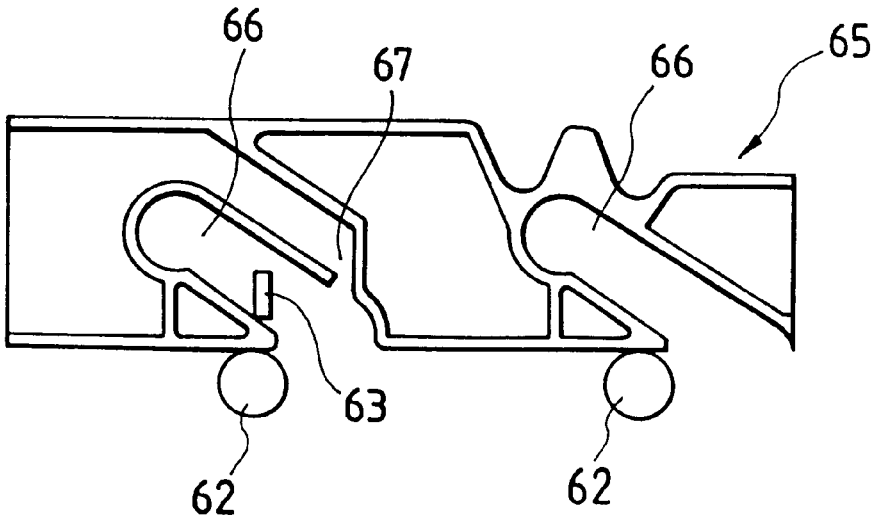
PRIOR ART FIG. 9
FIG. 9 is a front view showing the operation of the conventional structure which is performed when the position is not in the normal position.

FIG. 6 shows a state in which the guide pins 44 of the male connector 40 and the guide grooves 14 of the hood 11 are incompletely connected to one another. As shown in the drawing, the guide pins 44 are stopped immediately before the cut guides 11*e* of the hood 11. When the operation lever 20 has been rotated downwards in the state of the above-mentioned incomplete connection, the projection 27 of the operation lever 20 projecting over the side wall 22 toward the male connector 40 is brought into contact with the outer surface (the guide ribs 45) of the male connector 40, as shown in FIGS. 4(A) and 4(B). As a result of the contact, the downward rotation of the operation lever 20 can be inhibited. Therefore, the incomplete connection between the two connectors 30 and 40 can be detected in accordance with a fact that the rotation of the operation lever 20 has been inhibited. As a result, incomplete connection can be prevented.

The projection 27 is integrally formed by causing the side wall 22 of the operation lever 20 to project outwards. Therefore, the projection 27 has the same strength as that of the side wall 22. Since the projection 27 is directly brought into contact with the outer surface of the male connector 40, the male connector 40 receives the projection 27 with the outer surface thereof having the great strength. Therefore, great strength for inhibiting the rotation of the operation lever 20 can be obtained and, therefore, rotation of the operation lever 20 can reliably be inhibited. Moreover, breakage and deformation occurring when the rotation is inhibited can be prevented.

Since the projection 27 is provided with the side wall 22 in the portion into which the male connector is introduced, incomplete connection between the guide pins 44 and the guide grooves 14 can be detected immediately after the introduction of the male connector 40 has been started. Therefore, following countermeasures can quickly be taken.

In the above-mentioned embodiment, the engaging projection 18 is provided for the hood 11 and the engaging hole 25 is provided for the operation lever 20. The engagement hole may be provided for the hood and the engaging projection may be provided for the operation lever. In the above-mentioned embodiment, the slide members 13 having the guide grooves 14 are provided for the operation lever 20 and the guide pins 44 arranged to be engaged to the guide grooves 14 are provided for the female connector 30. The guide pins may be provided for the female connector and the slide members may be provided for the male connector.

As described above, according to an aspect of the present invention, the projection for inhibiting rotation of the operation lever in a state of incomplete connection between the guide grooves and the guide pins, is integrally formed with the operation lever. Therefore, great strength can be realized and the other connector receives the projection with the strong surface thereof. Therefore, rotation of the operation lever can be reliably inhibited even when a large force is applied. Moreover, breakage and deformation occurring when the rotation is inhibited can be prevented.

According to another aspect of the invention, incomplete connection between the guide pins and the guide grooves can be detected immediately after the introduction of the other connector has been started. Therefore, subsequent countermeasures can quickly be taken.

According to yet another aspect of the invention, the projection covers the outer surface of the other connector. Therefore, the projection inhibits movement of the other connector in the direction of separation. Therefore, a state of connection between the connectors can be stabilized.

What is claimed is:

1. A structure for connecting connectors, comprising:

a male connector portion;

a female connector portion;

a reciprocative and slidable first slide member provided with said female connector portion;

a rotative operation lever for sliding said first slide member;

a guide groove formed on said first slide member;

a guide pin formed on said male connector portion, and wherein a rotational operation of said operation lever causes said male connector portion to be introduced into said female connector portion so as to engaged said guide pin in said guide groove and connect said connector portions to each other; and a projection provided with said operation lever and arranged to contact an outer surface of said male connector portion when said guide groove and said guide pin are incompletely engaged with each other.

2. The structure for connecting connectors according to claim 1, wherein said projection is provided on a side wall of said operation lever.

3. The structure for connecting connectors according to claim 1, wherein said projection projects to cover a portion of an outer surface of said male connector portion when said male connector portion has been completely introduced into said female connector portion.

4. The structure for connecting connectors according to claim 1, further comprising a second slide member provide on said female connector portion, said second slide member operative to slide in an opposite direction to said first slide member when said operation lever is rotated.

5. The structure for connecting connectors according to claim 1, wherein, when said projection contacts the outer surface of said male connector portion, said operation lever is prevented from further rotation in a direction for introducing said male connector portion into said female connector portion.

6. The structure for connecting connectors according to claim 1, wherein the outer surface of said male connector portion includes a guide rib, and wherein said projection provided with said operational lever is arranged to contact said guide rib when said guide groove and said guide pin are incompletely engaged with each other.

7. The structure for connecting connectors according to claim 1, wherein when said projection is formed at a base of said operation lever adjacent a rotation axis of said operation lever.

* * * * *